US008152439B2

(12) United States Patent
Lawlor

(10) Patent No.: US 8,152,439 B2
(45) Date of Patent: Apr. 10, 2012

(54) METHOD AND APPARATUS FOR STARTING SUPERSONIC COMPRESSORS

(75) Inventor: Shawn P. Lawlor, Bellevue, WA (US)

(73) Assignee: Ramgen Power Systems, LLC, Bellevue, WA (US)

( * ) Notice: Subject to any disclaimer, the term of this patent is extended or adjusted under 35 U.S.C. 154(b) by 655 days.

(21) Appl. No.: 12/355,702

(22) Filed: Jan. 16, 2009

(65) Prior Publication Data

US 2009/0196731 A1 Aug. 6, 2009

Related U.S. Application Data

(60) Provisional application No. 61/011,528, filed on Jan. 18, 2008.

(51) Int. Cl.
*F04D 27/02* (2006.01)

(52) U.S. Cl. ..... 415/1; 415/145

(58) Field of Classification Search ..... 415/1, 145, 415/206, 211.2

See application file for complete search history.

(56) References Cited

U.S. PATENT DOCUMENTS

| | | | | |
|---|---|---|---|---|
| 2,628,768 | A | 2/1953 | Kantrowitz | |
| 2,721,693 | A | 10/1955 | Fabri et al. | |
| 2,853,852 | A | 9/1958 | Bodine, Jr. | |
| 2,971,329 | A | 2/1961 | Barry | |
| 2,971,330 | A | 2/1961 | Clark | |
| 3,524,458 | A | 8/1970 | Goldsmith | |
| 3,777,487 | A | 12/1973 | Norman et al. | |
| 3,783,616 | A | 1/1974 | Norman et al. | |
| 3,846,039 | A * | 11/1974 | Stalker | 415/206 |
| 3,993,414 | A | 11/1976 | Meauze et al. | |
| 4,000,869 | A | 1/1977 | Wong et al. | |
| 4,123,196 | A | 10/1978 | Prince, Jr. et al. | |
| 4,199,296 | A | 4/1980 | De Chair | |
| 4,445,816 | A | 5/1984 | Ribaud et al. | |
| 4,477,039 | A | 10/1984 | Boulton et al. | |
| 4,607,657 | A | 8/1986 | Hirschkron | |
| 4,741,497 | A | 5/1988 | Fox | |
| 4,872,807 | A | 10/1989 | Thompson | |
| 4,879,895 | A | 11/1989 | Sajben | |
| 5,074,118 | A | 12/1991 | Kepler | |
| 5,904,470 | A | 5/1999 | Kerrebrock et al. | |
| 6,009,406 | A | 12/1999 | Nick | |
| 6,358,012 | B1 | 3/2002 | Staubach | |
| 6,488,469 | B1 * | 12/2002 | Youssef et al. | 415/143 |

(Continued)

OTHER PUBLICATIONS

NACA Research Memorandum, Performance of an Impulse-Type Supersonic Compressor With Stators, John F. Klapproth, Guy N. Ullman and Edward R. Tysl, National Advisory Committee for Aeronautics, Washington, Apr. 28, 1952 (23 pages) with 1 page NASA Technical Reports Server (NTRS).

(Continued)

*Primary Examiner* — Chuong A Luu
*Assistant Examiner* — Nga Doan
(74) *Attorney, Agent, or Firm* — R. Reams Goodloe, Jr.

(57) ABSTRACT

A supersonic gas compressor. The compressor includes aerodynamic duct(s) situated on a rotor journaled in a casing. The aerodynamic duct(s) generate a plurality of oblique shock waves for efficiently compressing a gas at supersonic conditions. The convergent inlet is adjacent to a bleed air collector, and during acceleration of the rotor, bypass gas is removed from the convergent inlet via a collector to enable supersonic shock stabilization. Once the oblique shocks are stabilized at a selected inlet relative Mach number and pressure ratio, the bleed of bypass gas from the convergent inlet via the bypass gas collectors is eliminated.

71 Claims, 10 Drawing Sheets

U.S. PATENT DOCUMENTS

| | | | | |
|---|---|---|---|---|
| 6,920,890 | B2 | 7/2005 | Sanders et al. | |
| 7,147,426 | B2 | 12/2006 | Leblanc et al. | |
| 7,252,263 | B1 | 8/2007 | Hagemeister et al. | |
| 7,293,955 | B2 | 11/2007 | Lawlor et al. | |
| 7,334,990 | B2 | 2/2008 | Lawlor et al. | |
| 2005/0249578 | A1 * | 11/2005 | Leblanc et al. | 415/1 |
| 2006/0021353 | A1 | 2/2006 | Lawlor et al. | |

OTHER PUBLICATIONS

Inlet Unstart Boundaries AFT Bypass Closed, SR-71 Flight Manual (undated) (1 page).

Engine Stall Regions—Supersonic, SR-71 Flight Manual (undated) (1 page).

* cited by examiner 74
96
104
80
68
38
40
42
$S_N$
36
72
54
24
28
46
22
48
$S_2$
$S_1$
$S_3$
20
26
34
82

74
68
$S_I$
38
80
104
52
48
36
40
46
24
50
22
54
28
20
$S_U$
44
39
26
34
82

IMPACT OF SELF STARTING LIMITATION ON EFFICIENCY

IMPACT OF SELF-STARTING LIMITATION ON PRESSURE RATIO

IMPACT OF SELF-STARTING LIMITATION ON PERFORMANCE

METHOD AND APPARATUS FOR STARTING SUPERSONIC COMPRESSORS

RELATED PATENT APPLICATIONS

This invention claims priority from U.S. Provisional Patent Application Ser. No. 61/011,528 FILED Jan. 18, 2008, entitled METHOD AND APPARATUS FOR STARTING SUPERSONIC COMPRESSORS.

STATEMENT OF GOVERNMENT INTEREST

This invention was made with United States Government support under Contract No. DE-FC26-06NT42651 awarded by the United States Department of Energy. The Government has certain rights in the invention.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to compressors for efficiently compressing various gases, and more specifically, method(s) for starting gas compressors for stable operation at supersonic conditions, and to apparatus in which such method(s) are employed.

BACKGROUND

The development of improved, highly efficient compression processes have become increasingly important in view of ever increasing costs for energy. Further, in various power generation processes, including some of those integrated with fuel synthesis processes, the compression of residual or by-product various gases, including carbon dioxide, is expected to become more important and increasingly prevalent as the call for sequestration of carbon dioxide becomes more urgent. Thus, a reduction in gas compression costs by providing a gas compressor having high efficiency would be desirable in a variety of gas compression applications. When compressing high molecular weight gases, energy reduction and thus cost reduction become especially important.

In general, design methods associated with prior art supersonic compressors have encountered various difficulties. Some structures previously suggested have had or would have difficulty, as a practical matter, in ingesting an oblique leading edge shock pattern, and thus, have not been suitable for reliable starting in supersonic operation. Most such difficulties are problematic, since in order to maintain low shock losses at increased relative Mach numbers, the use of some sort of oblique shock system is generally required. However, an oblique shock wave system is of value in supersonic gas compression since it ultimately enables the maintenance of an operational pre-normal shock Mach number that is sufficiently low so that the total pressure loss at the terminal normal shock wave is minimized, thus preserving efficiency.

As a consequence of trying to provide low loss supersonic shock compression while maintaining a self starting compressor design, compressor designs have had a practical compression ratio upper limit. This is because the level of geometric contraction required to achieve a low loss supersonic compression process upstream of the normal shock wave results in a throat size, i.e. the cross-sectional flow area of minimum size of the aerodynamic duct in which supersonic compression occurs, that will not start at inlet relative Mach numbers required to achieve pressure ratios above about 2.5 to 1. In other words, in prior art designs known to me, the area of the throat of a compression duct compared to the area of capture at the inlet of such compression has needed to remain relatively large, roughly in the 85% range or higher, in order to enable such a design to "self start" with respect to the supersonic shock waves attendant to such designs.

Due to the above mentioned limitations inherent in self-starting supersonic compressor design, a method for the design of a supersonic compressor that enables the simultaneous provision of high pressure ratios, at least in the range above about 2.5 to 1, and moreover from that threshold up to a range of about 25 to 1 or more, and with high adiabatic efficiency, has not heretofore been provided.

Consequently, there still remains an as yet unmet need for a method of design for an easily started supersonic compressor that is capable of operating at high compression ratios in a stable and highly efficient manner under supersonic conditions. In order to meet such need and achieve and provide a method for the design of supersonic compressors that can achieve such operations, it has become necessary to address the basic technical challenges by developing new methods for starting such a supersonic compressor system. Thus, it would be advantageous to provide supersonic compressors that achieve supersonic shock capture in a suitably configured apparatus, while providing very high gas compression efficiencies in normal operation. Moreover, it would be advantageous to accomplish such goals while providing a compressor with high pressure ratios suitable for a single stage compressor design.

BRIEF DESCRIPTION OF THE DRAWING

The present invention will be described by way of exemplary embodiments, illustrated in the accompanying drawing in which like reference numerals denote like elements, and in which.

The foregoing figures, being merely exemplary, contain various elements that may be present or omitted from actual apparatus that may be constructed to practice the methods taught herein. An attempt has been made to draw the figures in a way that illustrates at least those elements that are significant for an understanding of the various methods taught herein for design, construction, and operation of high efficiency supersonic compressors. However, various other actions in the design of supersonic compressors using removal of a portion of bypass gas for starting of the compressor may be utilized in order to provide a versatile gas compressor that minimizes or eliminates starting difficulties and/or efficiency losses heretofore inherent in supersonic compressor designs.

DETAILED DESCRIPTION

Figure 7A:
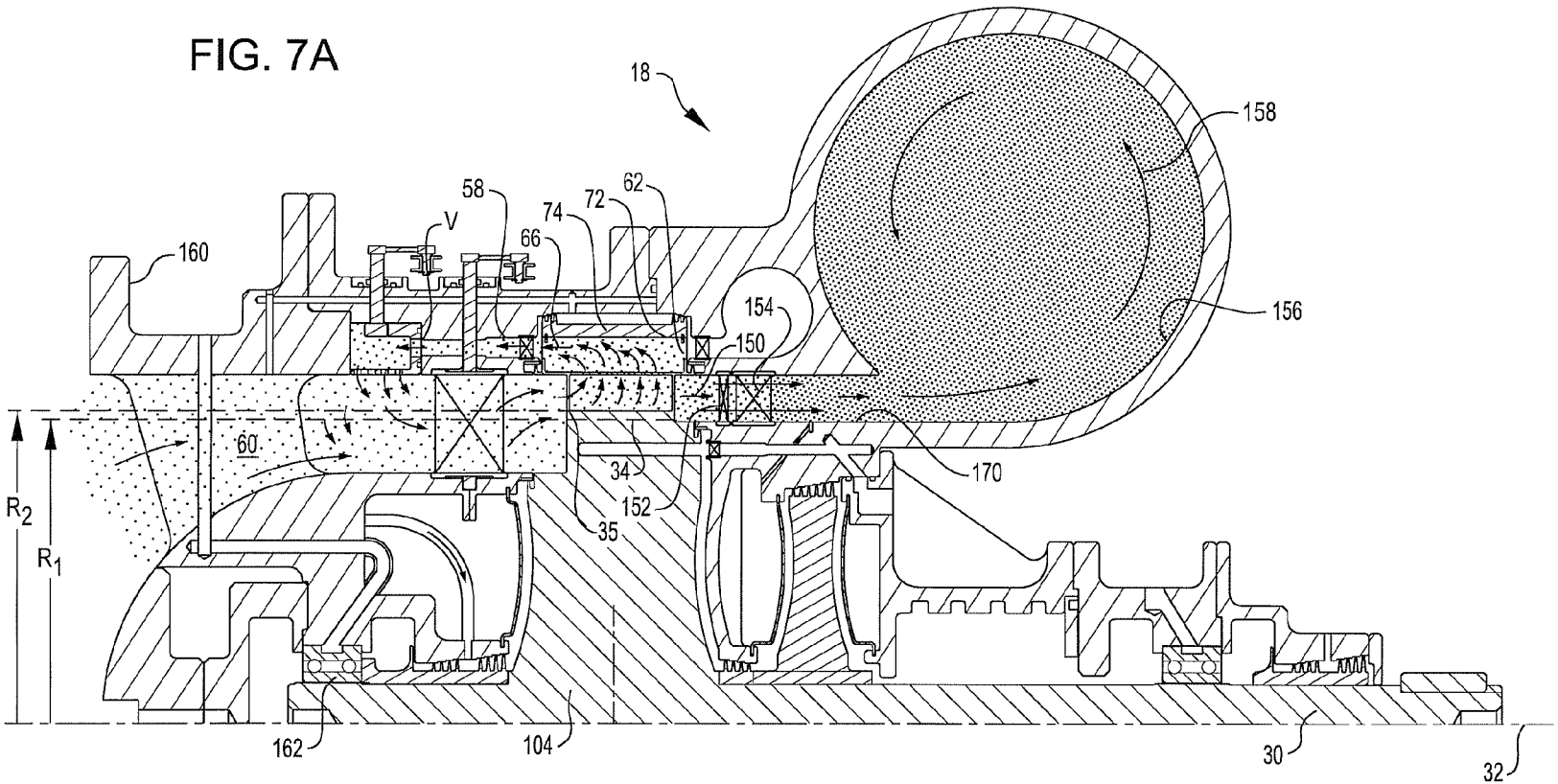
FIG. 7A is a partial vertical cross-sectional view of an upper portion for an embodiment wherein a stationary supersonic gas compressor is provided using the wheel first shown in FIG. 5 and using the starting bypass gas arrangement as just shown in FIG. 6 for the removal of a quantity of bypass gas from the converging inlet portion of an aerodynamic duct, and now showing an embodiment wherein bypass gas at startup is removed from along the upper portion or roof of an aerodynamic duct, and wherein the bypass gas is returned through a passageway and a valve to a low pressure incoming gas supply stream, and also showing use of a rotor on a rotating shaft journaled in a casing.

An exemplary method for the design and construction of a high compression ratio and highly efficient supersonic gas compressor, such as compressor 18 depicted in FIG. 7A, is set forth herein. Throughout this specification, there is discussion of the term inlet relative Mach number ("M"), as well as of a Mach number in the minimum cross-sectional passageway or throat of an aerodynamic duct. For purposes of this specification, unless expressly set forth otherwise, or unless another interpretation is required by the specific context mentioned, the various Mach numbers as discussed and described in detail herein are provided as mass averaged values, wherein the term mass averaged means that the local Mach numbers throughout the flow area of interest are weighted by the local mass flow and are subsequently averaged by the total flow. Mathematically this expression can be described by the following equation:

$$\overline{M} = \frac{\int_A \rho V M_l \, dA}{\int_A \rho V \, dA}$$

Where:

A=the reference area over which the Mach number is to be averaged

ρ=the local flow density

Figure 1:
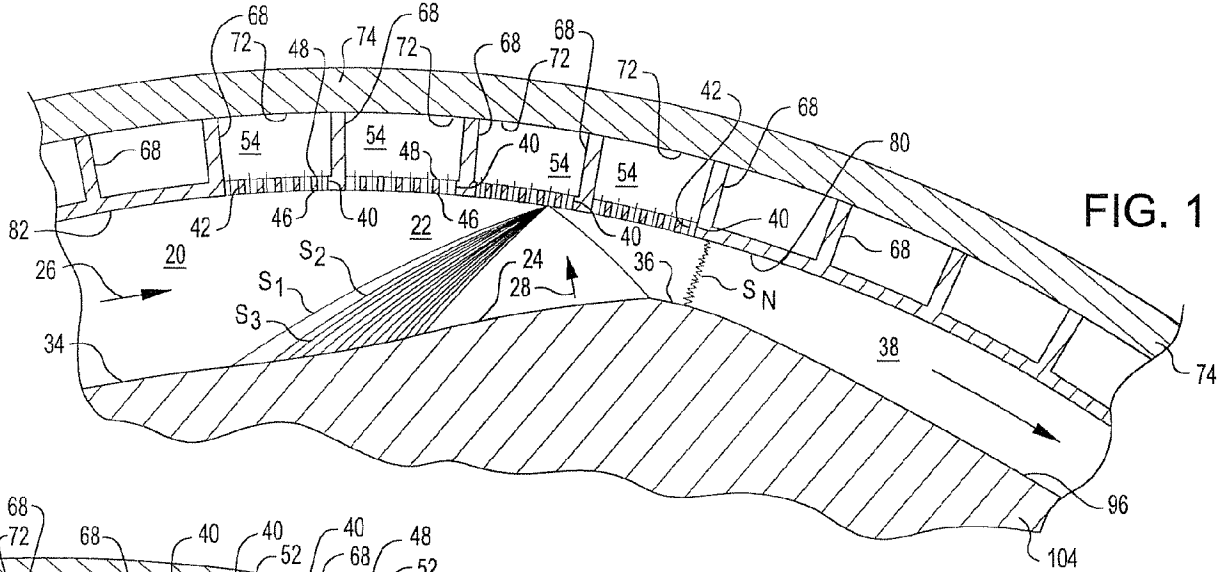
FIG. 1. provides a section view of an exemplary aerodynamic duct in which supersonic compression occurs in a supersonic gas compressor, wherein a converging inlet portion having a compression ramp is oriented to compress gas at least partially with a radially outward component, showing within a converging inlet portion the location of a plurality of oblique shock waves $S_1$, $S_2$, $S_3$, etc. in a gas being compressed, which oblique shocks serve to efficiently reduce the velocity of the incoming gas while increasing pressure and temperature, as well as a location of a normal shock wave $S_N$, at a suitable location as the gas passes through the minimum area throat and emerges into or travels within a divergent outlet portion of the aerodynamic duct.

V=the local flow velocity $M_l$=the local Mach number $\overline{M}$=the mass Averaged Mach number Attention is directed to FIG. 1, which provides a section view of an exemplary aerodynamic duct 20 that provides a bounding passage in which supersonic compression occurs in a supersonic gas compressor 18 configured according to the design techniques taught herein. The aerodynamic duct 20 includes a convergence inlet portion 22 having a compression ramps 24 are oriented to compress an incoming gas as designated by reference arrow 26 in an outward direction as indicated by reference arrow 28, which outward direction is at least partially with a radially outward with respect to the rotation of compressor. This can be appreciated by reference to FIG. 7A, as well as to FIG. 5, both of which have been marked to depict the differential between radius R1 (from a shaft 30 centerline axis of rotation 32 to a floor 34 of an aerodynamic duct 20 in a position upstream of compression ramps 24) and radius R2 (from a shaft 30 centerline 32 to a position 35 on a compression ramp 24 after at least some outward compression has been achieved).

Returning now to FIG. 1, shown within the converging inlet portion 22 is a plurality of oblique shock waves $S_1$, $S_2$, $S_3$, etc. resulting from supersonic compression of a gas. The oblique shocks $S_1$, $S_2$, $S_3$, etc., serve to efficiently reduce the velocity of the incoming gas while increasing its pressure and its temperature. During stable compressor operation at or near design conditions, a stable normal shock wave $S_N$, is positioned at a suitable location, usually at or shortly after the gas passes through the minimum area cross-sectional area (designated as a throat 36 in design terms used for aerodynamic ducts), or more broadly, as the gas emerges into or travels within a divergent outlet portion 38 of the aerodynamic duct 20. In any event, the design of the converging inlet portion 22 of the aerodynamic duct 20 is configured to produce a series of oblique shock waves (S1, S2, S3, S4, et cetera, to shock wave Sx, wherein X is a positive integer), which series of shock waves slows the inlet flow of captured gas in the converging inlet portion 22 from a selected design point inlet relative Mach number to a Mach number of between about 1.2 and about 1.5 at a reference location prior to or at the location of a normal shock wave $S_N$. The selected design point inlet relative Mach number is selected, of course, at a value above the reduced Mach number at the reference location prior to or at the normal shock wave. For practical purposes, useful inlet relative Mach numbers may be considered to be at about Mach 1.8 or higher, or in another embodiment, at about Mach 2 or higher, or in another embodiment, at about Mach 2.5 or higher. Techniques for the production of multiple oblique shock waves to accomplish such reduction in Mach number, with an attendant increase in static pressure and static temperature is adequately described in various prior art patents and literature; for example, the techniques set forth in U.S. Pat. No. 3,777,487, entitled Method and Apparatus for Reaction Propulsion, issued Dec. 11, 1973 to Norman et al, which patent is incorporated herein in its entirety by this reference, should be more than sufficient to allow one of ordinary skill in the art and to which this specification is addressed to provide such multiple oblique shock waves in a suitable apparatus.

Figure 2:
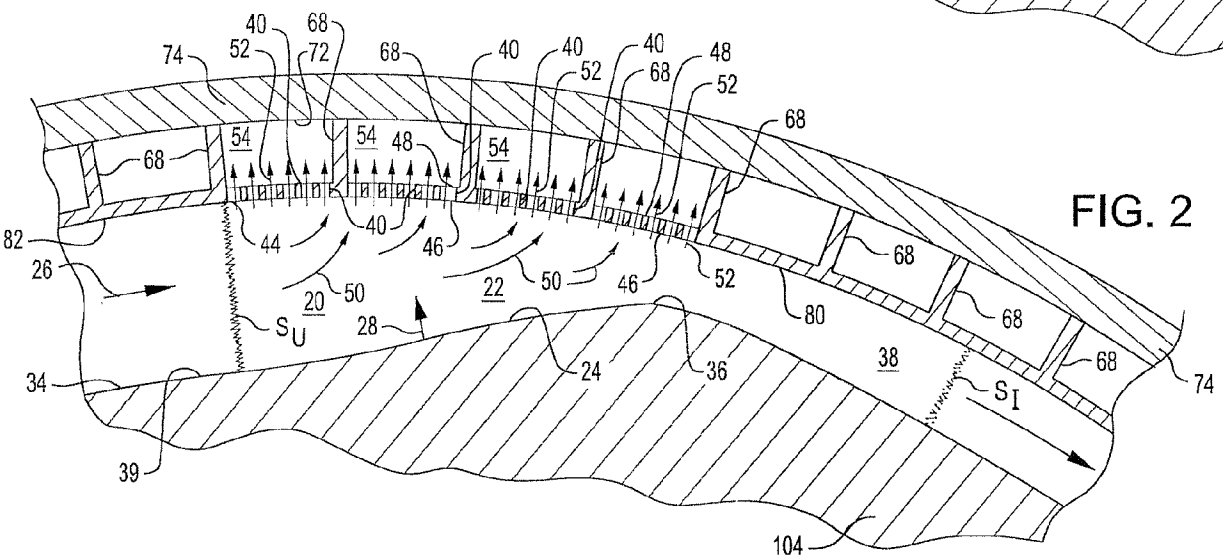
FIG. 2 provides a section view of the exemplary aerodynamic duct first illustrated in FIG. 1, but in this FIG. 2 shown in a condition wherein the aerodynamic duct is in an unstarted condition, with the unstarted supersonic shock wave $S_U$ located at or near the entry of the converging inlet portion of the aerodynamic duct, however, wherein as taught herein a bypass gas flow is removed from the converging inlet portion of the aerodynamic duct in order to begin the movement of the normal shock wave through the converging inlet in the direction of gas flow, to a location downstream of the converging inlet, ultimately to a location such as at an operating position for a normal shock $S_N$ just illustrated in FIG. 1.

FIG. 2 provides a section view of the exemplary aerodynamic duct 20 first illustrated in FIG. 1, but in this FIG. 2 shown in a condition wherein the aerodynamic duct 20 is in an unstarted condition, with the unstarted supersonic shock wave $S_U$ located at or near the entry 39 of the converging inlet portion 22 of the aerodynamic duct 20. However, in this FIG. 2, the method of removal of a quantity of bypass gas flow from the converging inlet portion 22 of the aerodynamic duct 20 is shown. Removal of such bypass gas directly from the converging inlet portion 22 eliminates or minimizes the choking effect of increased capture of gas 26 by the aerodynamic duct 20 at increasing speed during startup of the compressor, and allows downstream movement of a shock wave from the unstarted shock wave position noted as $S_U$, ultimately to the started shock wave position noted as $S_N$ in FIG. 1. However, during a startup sequence, after leaving location indicated as $S_U$, the shock may relocate to an intermediate location $S_I$ as indicated in hidden lines at a position further downstream within diverging outlet portion 38 of the aerodynamic duct 20, which intermediate position may be expected to vary, depending upon backpressure, instantaneous gas throughput as compared to design condition capacity, other operating conditions, and the control scheme utilized for the compressor. Ideally, the normal shock $S_N$ will be located at a position at or near the throat 36 so that losses are held to a minimum via gas expansion before occurrence of the normal shock $S_N$ operating position, as generally depicted in FIG. 1.

Further, in FIG. 2, exit conduits 40, as defined by interior sidewalls 42, are shown penetrating through first bounding portion 44 of aerodynamic duct 20, from a bounding side 46 to an exit side 48. In other words, a first bounding portion 44 of aerodynamic duct 20 includes perforations defined by interior sidewalls 42 that provide exit conduits 40. These exit conduits 40 are provided in sufficient size, shape, and quantity, and consistent with acceptable and manageable aerodynamic loss as further discussed below, in order to provide a bypass gas quantity within an acceptable range with respect to a selected design operating envelope, as also further discussed below. For embodiments of practical commercial attention, the sizing and quantity of such exit conduits 40 provide for removal of a bypass gas quantity, during startup, which increases as the inlet relative Mach number increases. Further, the bypass gas quantity required to be removed during starting, as a function of a particular inlet relative Mach number, is graphically set forth in FIG. 3. By cursory analysis of FIG. 3, it can be appreciated by those of ordinary skill in the art, to whom this specification is directed, that the quantities of bypass gas removed for a given design operating envelope, indicated as "starting bleed fraction," i.e. the ratio of mass of bleed bypass gas to the mass of captured gas entering aerodynamic duct 20, is in excess (and increasingly so at increasing inlet relative Mach number) of an amount of bleed that might be used in an aerodynamic technique for boundary layer control for reducing aerodynamic loss at high speed operation during operation. More precisely, the quantity of bypass gas fraction ($m_{bld}/m_{cap}$) used at a selected inlet relative Mach number, at a given design point, in selected operating envelope may be bounded by:

(a) an upper limit described by the equation $$(m_{bld}/m_{cap})=0.0329M^4-0.3835M^3+1.5389M^2-2.150M+0.9632$$

and (b) a lower limit described by the equation $$(m_{bld}/m_{cap})=0.0197M^4-0.230M^3+0.9233M^2-1.29M+0.5779$$

Where:

$m_{bld}$=mass of bypass gas bleed from the aerodynamic duct, $m_{cap}$=mass of gas captured by the aerodynamic duct, and M=the inlet relative Mach number for the aerodynamic duct.

Figure 5:
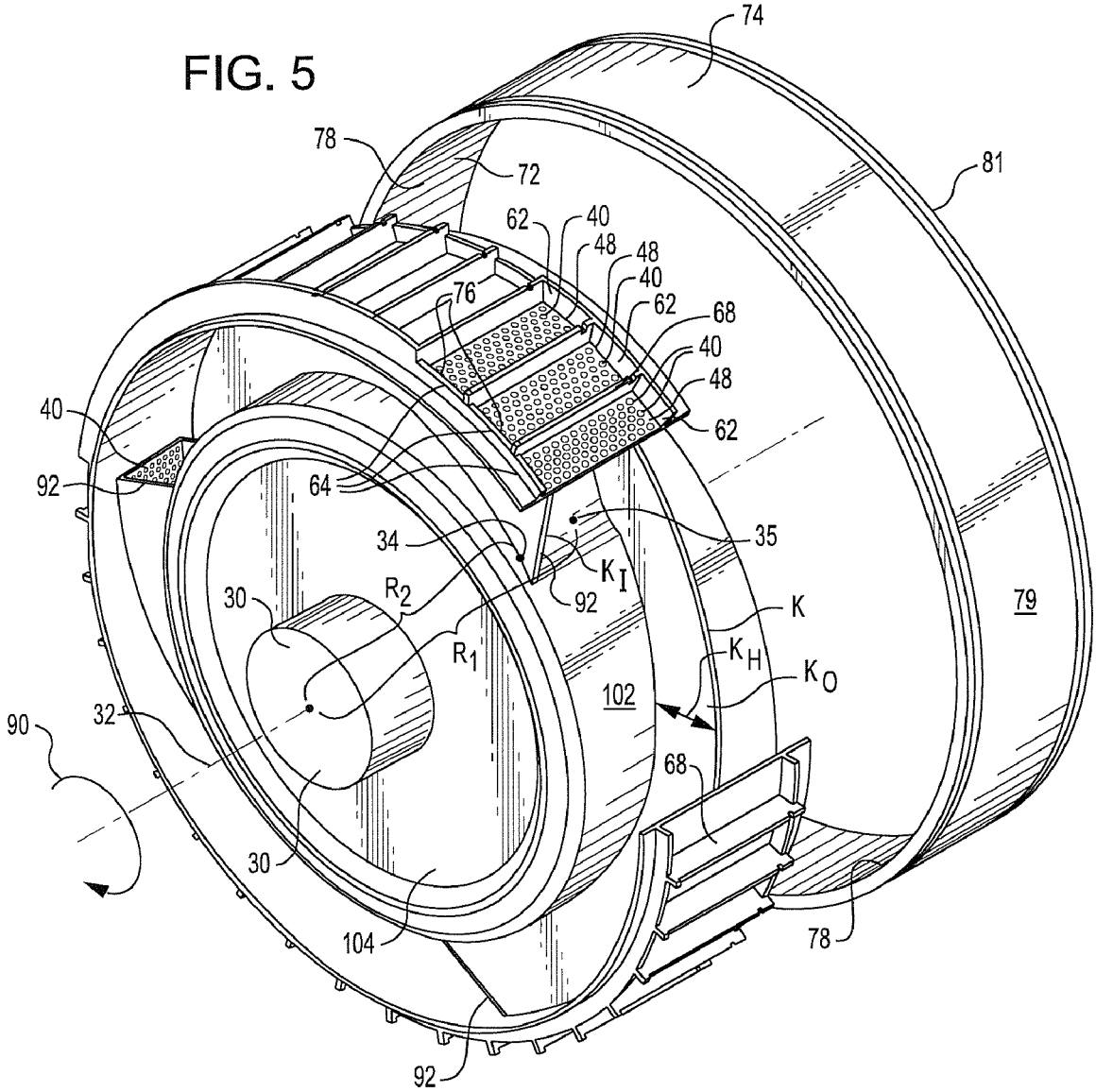
FIG. 5 provides a conceptual perspective view of key components of an embodiment for a gas compressor high speed wheel that, together with adjacent structure shown in other drawing figures (see FIGS. 6 and 7A) is configured for easy starting and efficient operation, showing a plurality of aerodynamic ducts mounted for rotary motion on a shaft mounted rotor, configured for utilizing bypass gas exit conduits that cooperate with adjacent structure to form and provide bypass gas passageways for removing gas directly from the converging inlet portion of the aerodynamic duct.
Figure 6:
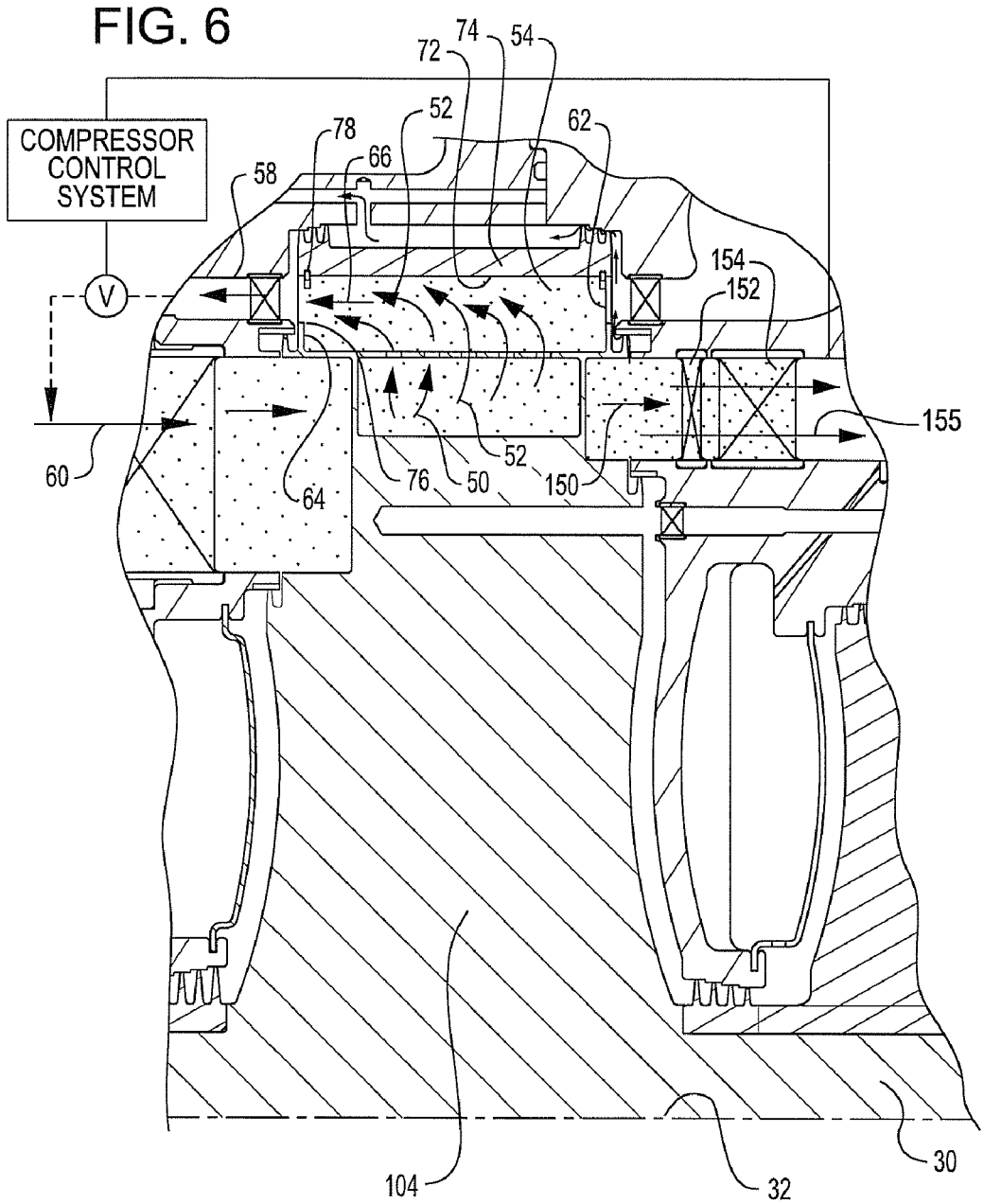
FIG. 6 is a partial vertical cross-sectional view of a portion of the gas compressor wheel first shown in FIG. 5, now showing details of one embodiment for providing bypass gas exit conduits on the rotor as a part of a bypass gas passageway to achieve starting of a supersonic gas compressor with high compression ratio, wherein a bypass gas collector providing at least in part an intermediate gas pressure chamber allows collection of the bypass gas from the converging inlet and provides a portion of a gas passageway for a selected quantity of bypass gas during a startup period, as first indicated in FIG. 2 above, to operation of the aerodynamic duct to move through a trans-sonic region until a stable oblique shock is established, as seen in FIG. 1 above, whereupon the flow of bypass gas as indicated in FIGS. 2, 6, and 7A is terminated.

Due to the presence of exit conduits 40, when the compressor control system valve V is open (see FIG. 6), a quantity of bypass gas (indicated by reference arrows 50) migrates toward the exit conduits 40, and thence through the exit conduits 40 (as indicated by reference arrows 52 in FIGS. 2 and 6) and into bypass gas collectors 54. Thus, a bypass gas passageway 58 is provided that is of increasing capacity (i.e., can conduct more mass, given the conditions of size, gas, temperature, differential pressure, etc.) as the inlet relative Mach number increases, as generally graphically depicted in FIG. 3, for example. The bypass gas collectors 54 direct the bypass gas away from the aerodynamic duct 20, by, in one embodiment as seen in FIGS. 5 and 6, directing the bypass gas through further bypass gas passageways 58 toward the low pressure gas inlet 60 of the compressor 18. As indicated in FIGS. 5 and 6, in an embodiment, the bypass gas collectors 54 are configured in a generally parallelepiped shape, as defined by (a) a bottom or floor that is provided by exit side 48 of a first bounding portion 44 of aerodynamic duct 20, (b) opposing collector boards, and more specifically a flow preventive collector board 62 on one side, and an overflow collector board 64 on the other side (over which bypass gas flows as noted by reference arrow 66 in FIG. 6), (c) opposing ribs 68, and (d) a ceiling provided by a portion of the interior 72 of rotor shroud 74. In an embodiment, the inlet to the bypass gas collectors 54 defined by exit conduits 40. In an embodiment, the outlet to bypass gas collectors 54 is defined (a) axially along opposing ribs 68 and (b) radially between the upper end 76 of overflow collector board 64 and an interior roof portion 78 of ceiling of interior 72 of rotor shroud 74.

Other structural details of the aerodynamic duct 20 include a second bounding portion 80, shown at the throat 36 and downstream as a roof in the diverging outlet portion 38. In an embodiment, along the diverging outlet portion 38, the use of ribs 68 may be maintained, for connection to the rotor shroud 74. In an embodiment, opposing the floor 34 upstream of compression ramp 24, a third bounding portion 82 may be provided, similarly using opposing ribs 68 and rotor shroud 74.

Overall, operation of a shrouded wheel supersonic compressor is as shown in FIGS. 5, 6, 7A, 7B, and 7C, is in many respects similar to the unshrouded compressor wheel design illustrated in U.S. Pat. No. 7,293,955, issued Nov. 13, 2007 to Lawlor et. al for a Supersonic Gas Compressor, the disclosure of which, including the specification, drawing figures, and claims, is incorporated herein in their entirety by this reference. More specifically, a compressor wheel rotates, in the direction of reference arrow 90 as noted in FIG. 5. As seen in FIG. 5, in an embodiment, one or more helical strakes K are provided adjacent each of one or more compression ramps 24. In one embodiment, the one or more helical strakes K extend from leading edge 92. Helical strakes K have a height $K_H$ have inlet interior walls $K_I$ and outlet interior walls $K_O$ that form lateral bounds of passageway provided by aerodynamic duct 20. Compression ramp 24 and first bounding portion 44 form radial bounds for a portion of the passageway provided by aerodynamic duct 20. Similarly, throat 36 and floor 96 of diverging outlet portion 38 act with second bounding portion 80 to form radial bounds for a portion of the passageway provided by aerodynamic duct 20.

Strakes K effectively separate the low pressure inlet gas 100 from high pressure compressed gas downstream at each one of the aerodynamic ducts 20. In an embodiment, strakes K are provided in a generally helical structure extending radially outward from an outer surface portion 102 of rotor 104 to an outward bounding region of the passageways provided by aerodynamic ducts 20. As noted above, in an embodiment, first bounding portion 44 and second bounding portion 80 form a significant portion of such outward bounding region. In an embodiment, the third bounding portion 82 may also provide a portion of such outward bounding region. In an embodiment, the number of strakes K is equal to the number of compression ramps 24. In an embodiment, a compression ramp 24 may be provided for each aerodynamic duct 20. The number of aerodynamic ducts may be selected as appropriate for the required service, gas being compressed, mass flow, pressure ratio, etc., as most advantageous for a given service. In some embodiments, the number of aerodynamic ducts 20 provided for rotary motion on a single stage rotor may be 3, or 5, or 7, or 9.

As shown in FIGS. 6 and 7A, during starting, compressor 18, via valve V in a compressor control system, opens a passageway 58 between the aerodynamic duct 20 and the low pressure gas inlet 60. A selected quantity of bypass gas is thus routed from the aerodynamic duct 20 to the low pressure gas inlet 60. Once the compressor 18 reaches a stable operating condition with the oblique shock waves stabilized, then the bypass gas is reduced and ultimately eliminated, thus enabling the compressor 18 to operate at high pressure ratios while maintaining high efficiency.

Figure 3:
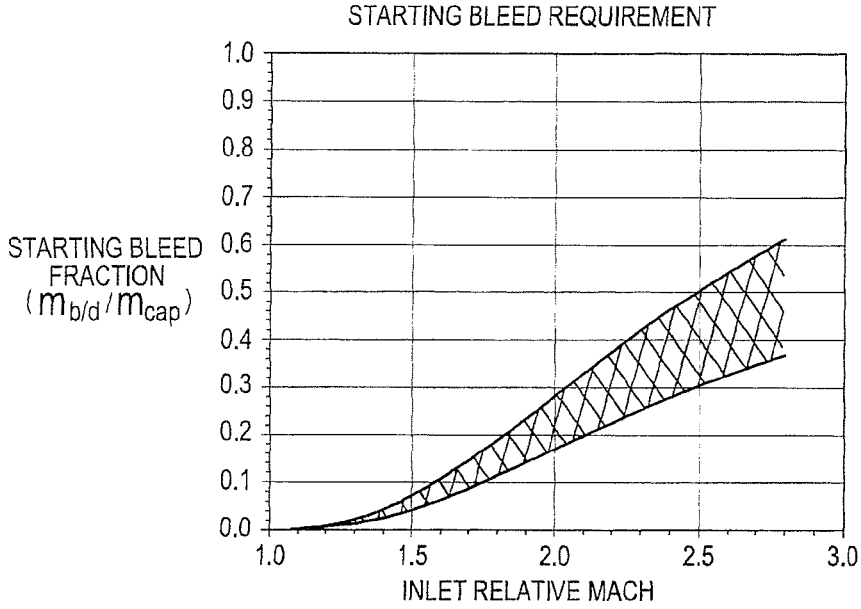
FIG. 3 provides a graphic illustration of a suitable range for starting bypass gas removal requirements (noted on the vertical axis as starting bleed fraction, defined by mass of bypass gas bleed divided by mass of inlet gas captured) for a aerodynamic duct for a supersonic compressor operating at a selected inlet relative Mach number.
Figure 4:
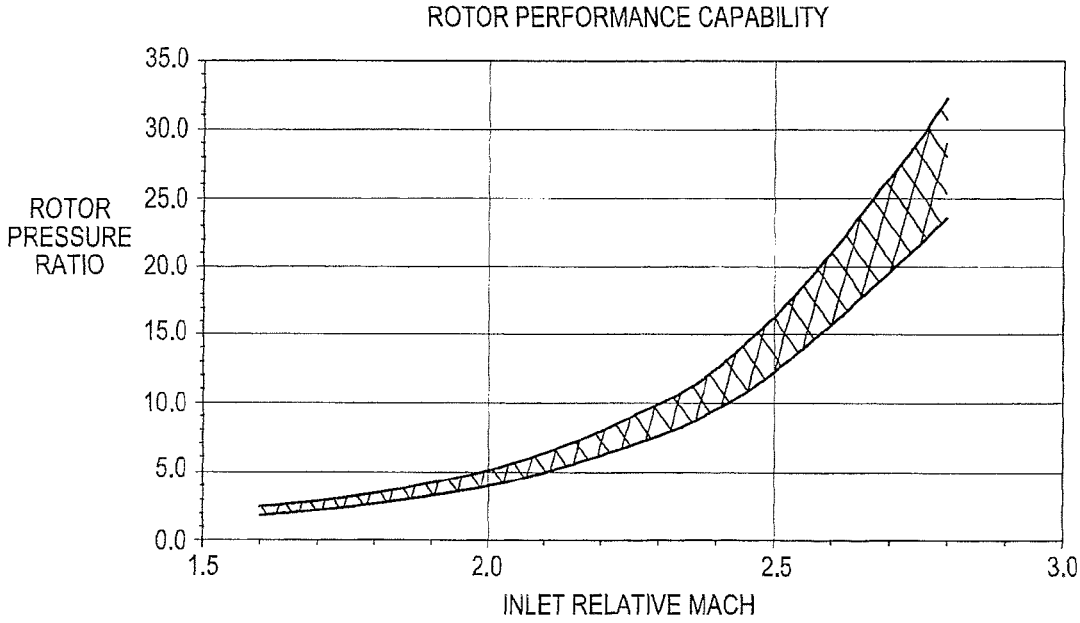
FIG. 4 provides a graphic illustration of achievable gas compressor pressure ratio capability of a compressor designed with an aerodynamic duct and starting gas bypass as taught herein, as a function of a selected inlet relative Mach number.

As earlier noted above, FIG. 3 provides a graphic illustration of a suitable range for starting bypass gas removal requirements (noted on the vertical axis as starting bleed fraction, defined by mass of bypass gas bleed divided by mass of inlet gas captured) for a aerodynamic duct 20 for a supersonic compressor 18 operating at a selected inlet relative Mach number. Thus, for desired target inlet relative Mach number, the bypass gas removal passageways, including exit conduits 40 and bypass gas collectors 54, need to be sized and shaped to receive therethrough the required quantity of bypass gas. With respect to selection of a desired target inlet relative Mach number, FIG. 4 provides the range of inlet relative Mach numbers achievable by some embodiments for a compressor 18 configured according to the teachings herein.

In addition to the embodiment for an aerodynamic duct 20 as noted in FIGS. 1 and 2 above, other configurations may be feasible and several additional embodiments are noted herein for providing advantageous wheel mounted bounding passageways for supersonic compression.

Figure 8:
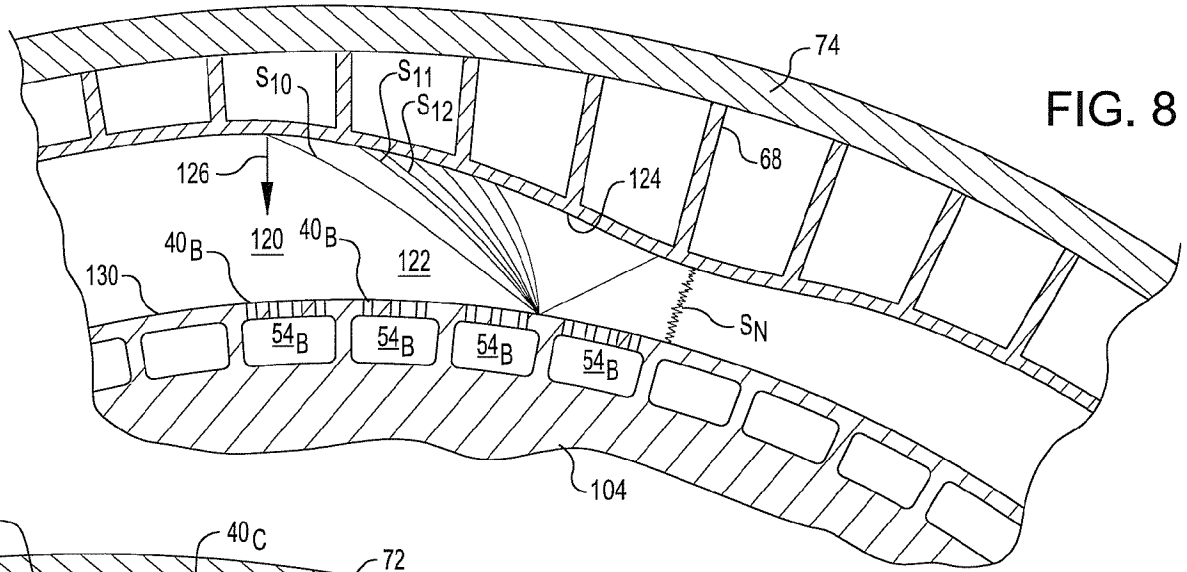
FIG. 8 provides a section view of another embodiment for an exemplary aerodynamic duct operating at supersonic compression conditions in a gas compressor, similar to the embodiment first illustrated in FIG. 1 above, but now showing an aerodynamic duct that provides compression using a converging inlet wherein a compression ramp is oriented to compress gas at least partially radially inward, while utilizing a plurality of oblique shock waves $S_1$, $S_2$, $S_3$, etc. which serve to efficiently reduce the velocity of the incoming gas while increasing pressure and temperature.

FIG. 8 provides a section view of another embodiment for an exemplary aerodynamic duct 120 operating at supersonic compression conditions in a gas compressor, similar to the embodiment first illustrated in FIGS. 1 and 2 above, but now showing an aerodynamic duct 120 that provides compression using a converging inlet 122 wherein a compression ramp 124 is oriented to compress gas at least partially radially inward, as indicated by reference arrow 126, while utilizing a plurality of oblique shock waves $S_{10}$, $S_{11}$, $S_{12}$, etc., which serve to efficiently reduce the velocity of the incoming gas while increasing pressure and temperature. For starting in such an embodiment, exit conduits $40_B$ are provided, and bypass gas collectors $54_B$ are provided, each of which functionally and structurally are substantially comparable to exit conduits 40 and collectors 54 noted above with respect to the structures described in detail in relation to FIGS. 1 and 2.

Figure 7B:
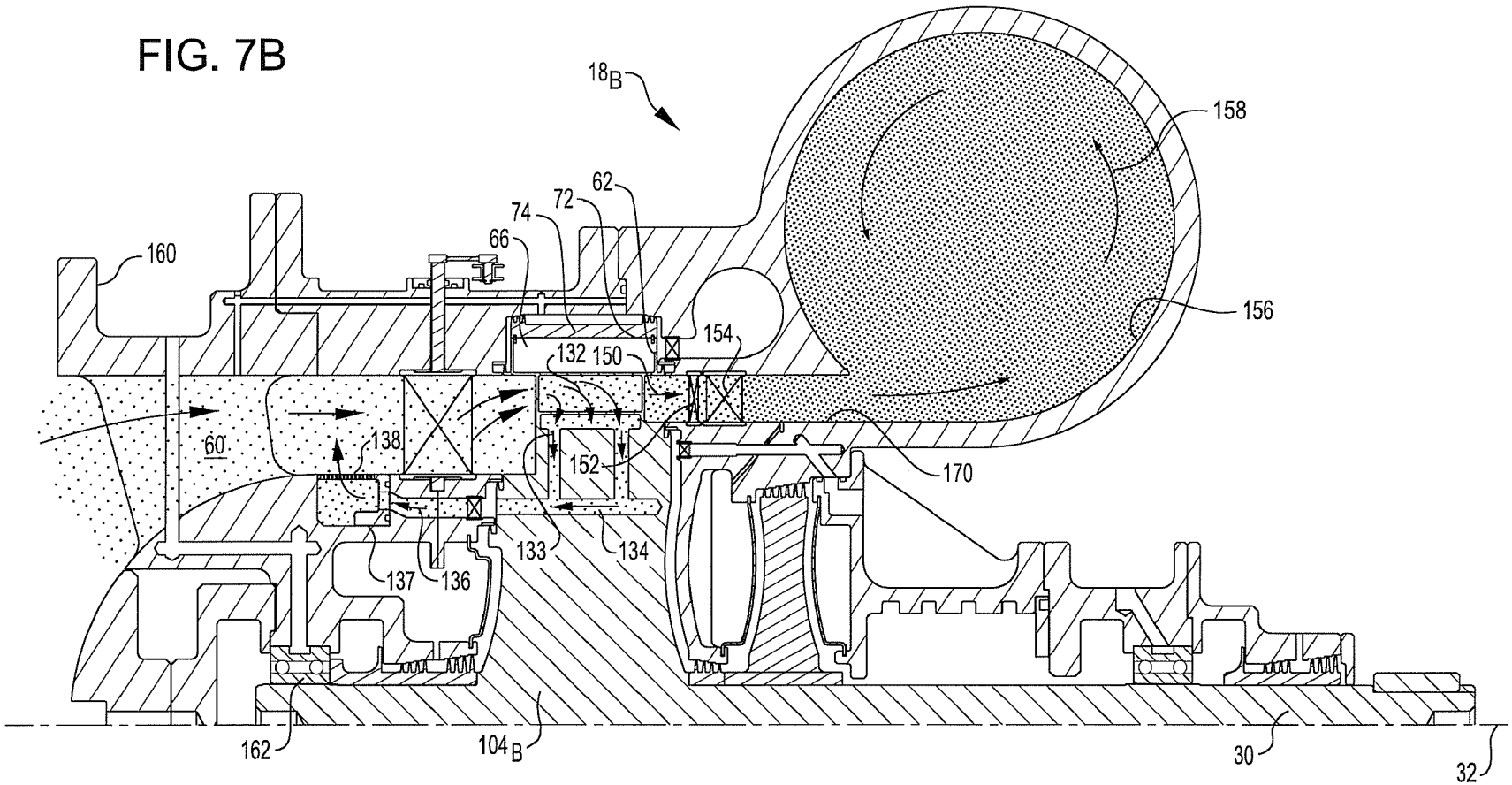
FIG. 7B is a partial vertical cross-sectional view of an upper portion for another embodiment of a supersonic gas compressor using a starting bypass gas arrangement, utilizing the method of removal of a quantity of bypass gas from the converging inlet portion of an aerodynamic duct, now illustrating an embodiment wherein the bypass gas at startup is removed on the rotor side (or floor) of the converging inlet of an aerodynamic duct.

Attention is directed to FIG. 7B, wherein a cross-sectional view of an embodiment for a compressor utilizing a rotor $104_B$ that has thereon aerodynamic duct(s) 120 as just described above in the discussion with respect to FIG. 8. At time of starting (not illustrated functionally in FIG. 8, but rather in FIG. 7B), the exit conduits $40_B$ positioned in the floor 130 side of aerodynamic duct(s) 120, accept therethrough an amount of bypass gas as indicated by reference arrow 132. A bypass gas passageway 134 is provided that has a selected design size of increasing gas flow capacity (i.e., can conduct more mass, given the conditions of passageway physical size, gas, temperature, differential pressure, etc.) as the design inlet relative Mach number increases. The bypass gas sent through exit conduits $40_B$ in the floor located bypass gas collectors $54_B$ (see FIG. 8), is directed away from the aerodynamic duct(s) 120 as indicated by reference arrow 133 and into lower bypass gas passageway 134. In an embodiment as seen in FIG. 7B, the collected bypass gas as indicated by reference arrow 136 passes through further portions of bypass gas passageways 134, and travels through valve 137, then through lower bypass gas outlet 138 and on toward the low pressure gas inlet 60 of the compressor $18_B$.

Figure 9:
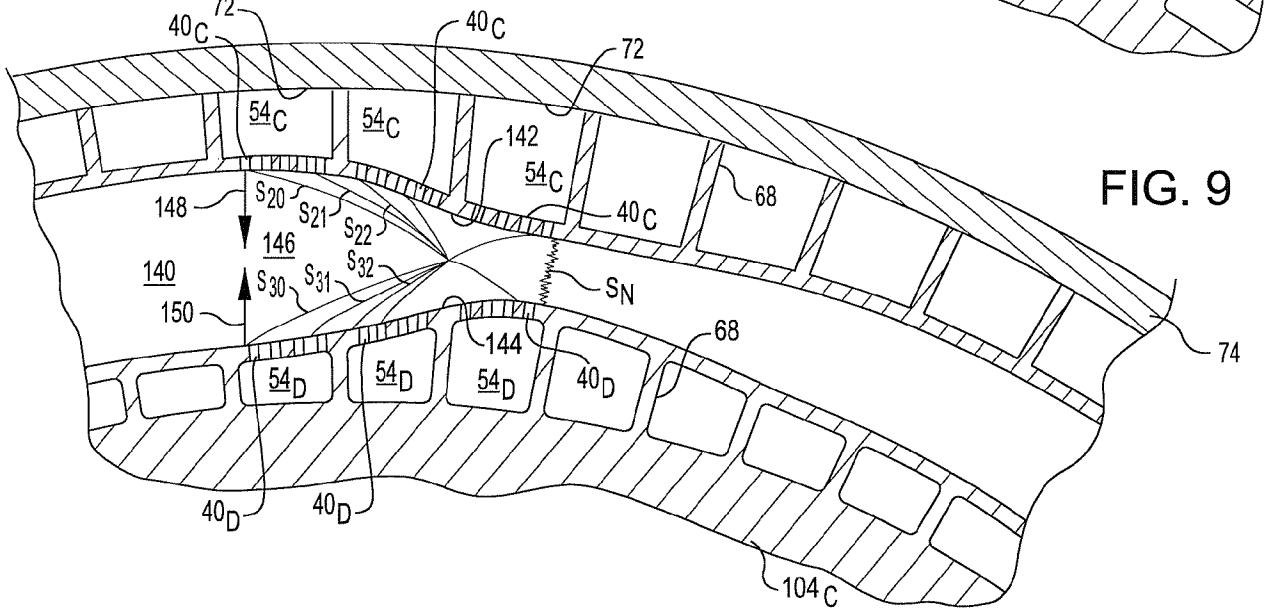
FIG. 9 provides a section view of yet another embodiment for an exemplary aerodynamic duct operating at supersonic compression conditions in a gas compressor, similar to the embodiments illustrated in FIG. 1 or 8 above, but now showing compression in an aerodynamic duct that provides compression using a converging inlet wherein compression ramps are oriented to compress gas at least partially radially inward and at least partially radially outward, but still showing a plurality of oblique shock waves $S_1$, $S_2$, $S_3$, etc. which serve to efficiently reduce the velocity of the incoming gas while increasing pressure and temperature.
Figure 10:
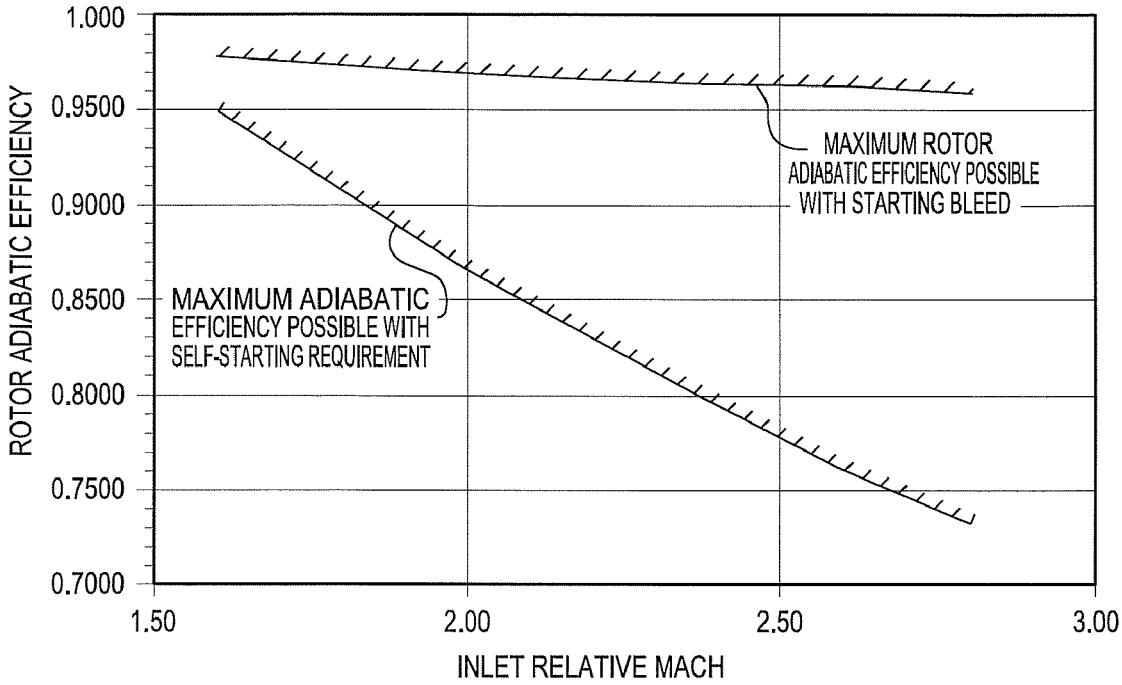
FIG. 10 provides a graphic illustration of the distinct and significant advantages in adiabatic efficiency as a function of inlet relative Mach number, for a supersonic compressor designed according to the principles provided herein, as compared to prior art self starting supersonic compressors.
Figure 11:
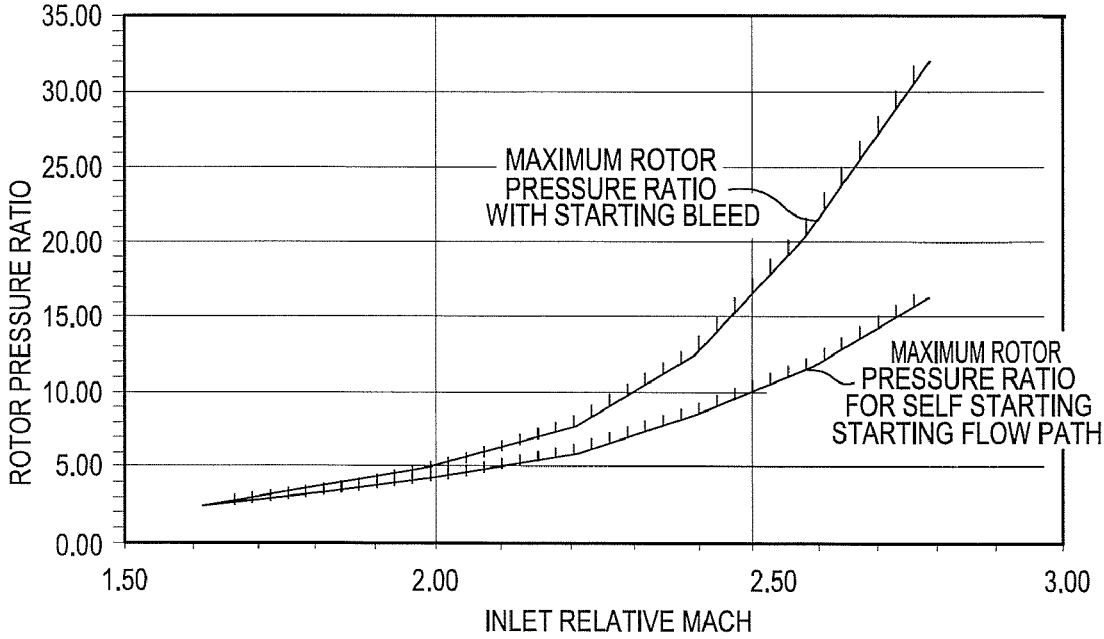
FIG. 11 provides a graphic illustration of the distinct and significant advantages in pressure ratios available at various Mach numbers, and especially at higher Mach numbers in the range of 2 or greater, and further in the range of 2.5 or greater, of a supersonic compressor designed according to the principles provided herein, as compared to prior art self starting supersonic compressors.
Figure 12:
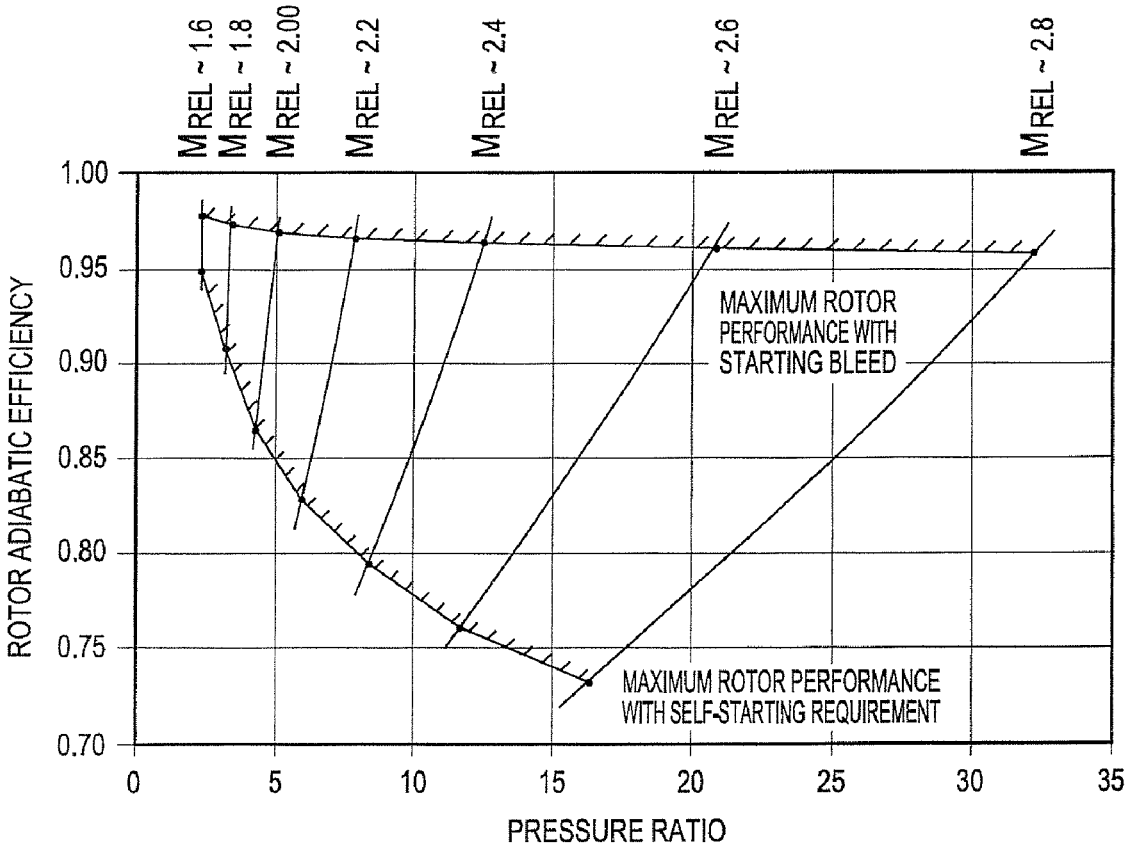
FIG. 12 provides a graphic illustration of the distinct and significant advantages in adiabatic efficiency as a function of gas compression or pressure ratio, for a supersonic compressor designed according to the principles provided herein, as compared to prior art self starting supersonic compressors.

Similarly, in FIG. 9 yet another embodiment for an exemplary aerodynamic duct 140 is provided for use in a supersonic gas compressor such as compressor 18. In this figure, use of opposing compression ramps 142 and 144 is indicated in converging inlet 146. The compression ramp structure 142 is oriented to compress gas at least partially radially inward as indicated by reference arrow 148. Compression ramp 144 is oriented to compress gas at least partially radially outward as indicated by reference arrow 150. Efficient compression is accomplished utilizing a plurality of oblique shock waves $S_{20}$, $S_{21}$, $S_{22}$, and $S_{30}$, $S_{31}$, $S_{32}$, etc. which serve to efficiently reduce the velocity of the incoming gas while increasing pressure and temperature. For starting in such an embodiment, exit conduits $40_C$ and $40_D$ are provided, and bypass gas collectors $54_C$ and $54_D$ are provided; functionally and structurally these are substantially the same as noted above with respect to the exit conduits 40 and the collectors 54 described in detail in relation to FIGS. 1 and 2.

Figure 7C:
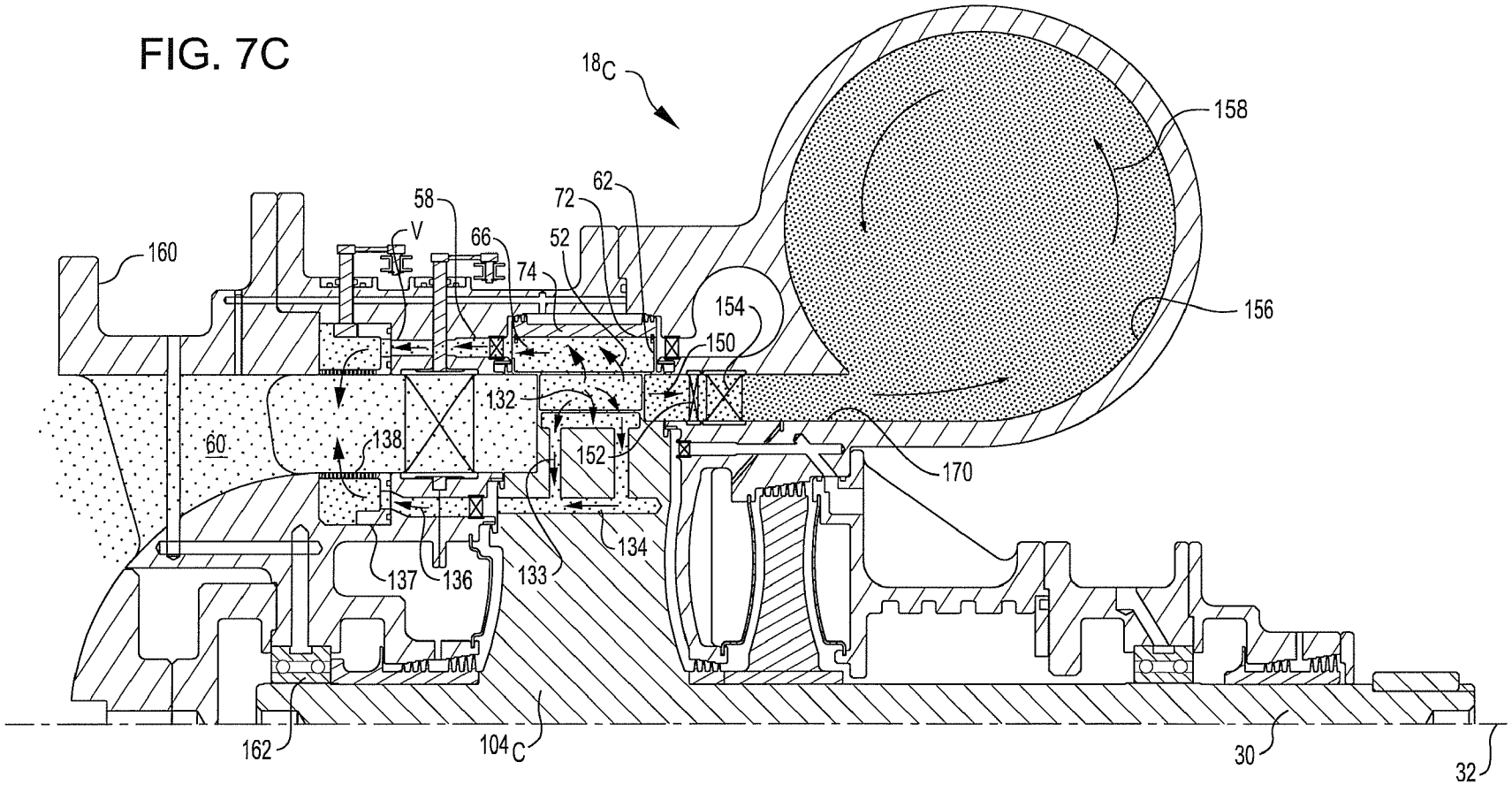
FIG. 7C is a partial vertical cross-sectional view of an upper portion of a supersonic gas compressor using a starting bypass gas arrangement, utilizing the method of removal of a quantity of bypass gas from the converging inlet portion of an aerodynamic duct, now illustrating an embodiment wherein the bypass gas at startup is removed both (a) on the rotor side (or floor) of the converging inlet of an aerodynamic duct, and (b) the ceiling (in this embodiment, a radially distal side with respect to the rotor), and returning the bypass gas through a valve to the incoming gas stream.

Attention is directed to FIG. 7C, wherein a cross-sectional view of an embodiment for a compressor utilizing a rotor $104_C$ that has thereon aerodynamic duct(s) 140 as just described above in the discussion with respect to FIG. 9. At time of starting (not illustrated functionally in FIG. 9, but rather in FIG. 7C), the exit conduits $40_C$ and $40_D$, positioned in the roof side compression ramp 142 and in the floor side compression ramp 144, respectively, accept therethrough bypass gas as indicated by reference arrows 52 and 132, respectively. The bypass gas (as indicated by reference arrows 52) sent through exit conduits $40_C$ in the roof located bypass gas collectors $54_C$, is directed away from the aerodynamic duct 140 and into bypass gas passageway 58. The collected bypass gas as indicated by reference arrow 66 passes through further portions of bypass gas passageways 58, and travels toward the low pressure gas inlet 60 of the compressor $18_C$. The lower bypass gas passageway 134 is provided that has a selected design size of increasing gas flow capacity (i.e., can conduct more mass, given the conditions of passageway physical size, gas, temperature, differential pressure, etc.) as the design inlet relative Mach number increases. The bypass gas sent through exit conduits $40_B$ in the floor located bypass gas collectors $54_B$ (see FIG. 8), is directed away from the aerodynamic duct(s) 120 as indicated by reference arrow 133 and into lower bypass gas passageway 134. In an embodiment as seen in FIG. 7B, the collected bypass gas as indicated by reference arrow 136 passes through further portions of bypass gas passageways 134, and travels through valve 137, then through lower bypass gas outlet 138 and on toward the low pressure gas inlet 60 of the compressor $18_C$.

In any event, once the gas being compressed passes the aerodynamic duct 20, or other suitable embodiments (such as described in FIGS. 7B and 8, or in FIGS. 7C and 9), the high speed compressed gas exits the rotor through a passageway as indicated by reference arrow 150, and then in an embodiment may pass through an array of diffusers 152 and 154, as indicated by reference arrow 155, before entering a volute 156 as indicated by reference arrows 158, in which the velocity slows and static pressure is accumulated.

The compressor 18 described herein may be utilized for compression of various gases. Benefits using such a compressor design are especially seen with gases in which the speed of sound at standard aerodynamic conditions (1 atmosphere, 60° F.) is at or about that of nitrogen or lower. Also, gases with high molecular weight may be compressed with compressors designed as set forth herein with significant benefit, especially when handling those gases with a molecular weight of nitrogen or higher. Some of such gases may include hydrocarbons, such as ethane, propane, butane, pentane, and hexane, as well as other high molecular weight compounds such as carbon dioxide, sulfur dioxide, or very high molecular weight compounds such as uranium hexafluoride.

In short, compressors provided according to the designs provided herein are particularly well suited to applications involving gases with low sound speeds where high pressure ratios are required, such as carbon dioxide or propane, where high Mach number compression designs are advantageous. For example compression of carbon dioxide to a discharge pressure of from between about 1500 psia to about 2200 psia can be accomplished in a cost effective manner. Similarly, propane compression for natural gas liquefaction requires propane compression at pressure ratios of from about 16:1 to about 50:1, depending upon the details of the process selected. The combination of relatively low speed of sound in propane, and high pressure ratios required, make such service an ideal candidate for the compressor designs taught herein.

Attention is directed to FIG. 7A, where a partial vertical cross-sectional view is provided of a supersonic gas compressor 18. The compressor 18 includes a casing 160 that has a low pressure gas inlet 60 for admitting a main flow of low pressure gas to be compressed. The casing has a high pressure gas exit, here represented by volute 156, from which a flow of high pressure compressed gas is discharged. Rotor 104 is journaled via shaft 30 in casing 160, such as with bearings 162. Provided with rotor 104 are aerodynamic ducts 20, which in an embodiment as depicted in FIG. 5, may be bounded laterally and thus configured in helical fashion between helical strakes K, along axis of rotation 32. Aerodynamic aspects of duct 20 have been adequately discussed above; however, in each compressor design, the aerodynamic ducts 20 are provided having an inlet relative Mach number for operation associated with a design operating point selected within a design operating envelope for the selected gas composition, gas quantity, and gas compression ratio. In an embodiment, a plurality of aerodynamic ducts 20 is mounted on the rotor 104. In an embodiment, wherein bypass gas collectors 54 are co-located for rotary movement with each of the aerodynamic ducts 20. In an embodiment such as that depicted in FIG. 5, three aerodynamic ducts 20 are provided.

Bypass gas passageway(s) 58 are provided and configured for placement in an open, fluid conducting position, such as by opening valve V for bypass gas passage, during the process of starting of the gas compressor 18. Likewise, the bypass gas passageway(s) 58 are provided and configured for placement in a closed position, such as by closing valve V, in order to effectively eliminate the removal of bypass gas (such as indicated by reference arrow 50 in FIG. 6) after startup of the compressor. In such embodiments, a valve V associated with the bypass gas passageways is configured for opening and closing the fluid conductivity of the bypass gas passageways.

In an embodiment the bypass gas passageway(s) 58 are adapted to receive bypass gas 50 from the aerodynamic ducts 20 and return the bypass gas to the low pressure gas inlet 60. In an embodiment, the bypass gas passageway(s) further include one or more bypass gas collectors 54, as seen for example in FIGS. 1 and 2, and as may be better appreciated in FIG. 5. A plurality of exit conduits 40 provide a fluid connection between the converging inlet portion 22 of the aerodynamic duct 20 and the bypass gas collectors 54. In an embodiment, the one or more bypass gas collectors 54 are each co-located with one of the aerodynamic ducts 20, and are mounted for rotary movement therewith. The bypass gas collectors 54 are shaped and sized to facilitate removal of a bypass portion of gas as indicated by reference arrow 50 directly from said aerodynamic ducts via exit conduits 40 defined by sidewalls 46 between an aerodynamic duct third bounding portion 82 of the converging inlet portion 22, and the exit side (floor 48) of the bypass gas collectors 54. In an embodiment, a compressor is sized to provide a quantity of bypass gas within the ranges as depicted in FIG. 3. In an embodiment, the various components of bypass gas passageway(s) 58, including exit conduits 40, bypass gas collectors 54, valve V, and associated piping and fluid conduits as may be necessary in a particular design configuration, are sized and shaped for removal of a selected quantity of bypass gas that increases as the inlet relative Mach number increases, wherein a quantity of bypass gas selected from a range of (a) from about 11% by mass to about 19% by mass of the inlet gap captured by the converging inlet portion for operation at an inlet relative Mach number of about about 1.8, to (b) from about 36% by mass to about 61% by mass of the inlet gas captured by the converging inlet portion 22 for operation at an inlet relative Mach number of about 2.8.

In an embodiment, the inlet relative Mach number of the aerodynamic duct(s) is in excess of 1.8. In an embodiment, the inlet relative Mach number of said aerodynamic duct is at least 2. In yet another embodiment, the inlet relative Mach number of said aerodynamic duct is at least 2.5. In a yet further embodiment, the inlet relative Mach number is in excess of about 2.5. In a still further embodiment, the inlet relative Mach number the aerodynamic duct(s) is between about 2 and about 2.5, inclusive of such bounding parameters. In another embodiment, the inlet relative Mach number of the aerodynamic duct(s) is between about 2.5 and about 2.8, inclusive of such bounding parameters.

For most designs, of compressors according to the teachings herein, at the design operating point, the Mach number before a normal shock at the design position location, is in a range of from about 1.2 to about 1.5.

High efficiency at high gas compression ratio is one hallmark of the most advantageous portions of a design operating envelope achievable by compressors designed as taught herein. However, compressors may be provided wherein the design operating envelope comprises a gas compression ratio of at least 3. On an embodiment, the design operating envelope may include a gas compression ratio of at least 5. Further, in an embodiment, a gas compression ratio of somewhere from about 3.75 to about 12, inclusive of said parameters, may be provided. In yet another embodiment of such designs, a design operating envelope may include a gas compression ratio somewhere in the range of from about 12 to about 30, inclusive of said parameters. With certain designs, a design operating envelope may be provided wherein the gas compression ratio is in excess of 30.

As noted in FIGS. 8 and 9, as contrasted to FIGS. 1 and 2, differing variations for compression ramp portions of an aerodynamic duct may be provided. As noted in FIGS. 1, 2, and 9, an aerodynamic duct may include a converging inlet having a compression ramp that compresses incoming gas at least partially radially outward, such as shown by reference arrow 28 in FIGS. 1 and 2, or reference arrow 150 in FIG. 9. As noted in FIG. 9, a second compression ramp may be provided, wherein the second compression ramp is oriented to compress an incoming gas at least partially radially inward, as noted by reference arrow 148 in FIG. 9. In a still further embodiment, as depicted in FIG. 8, an aerodynamic duct may include a converging inlet that only utilizes a having a compression ramp that compresses incoming gas at least partially radially inward, as noted by reference arrow 126 in FIG. 8.

While the exact design of an aerodynamic duct may vary in various design configurations, for ease of construction, it may be useful and save materials, weight, and space if the bypass gas collectors 54 are at least partially defined by a floor (exit side) 48 that is also an exterior portion of a third bounding portion 82 of an aerodynamic duct 20, as shown in FIG. 1. As better seen in FIGS. 1 and 5, the bypass gas collectors 54 may also be at least partially defined by axially oriented and radially extending opposing ribs 68. Also, the bypass gas collectors 54 may be at least partially defined by opposing collector boards, said opposing collector boards provided in pairs, wherein an upstream collector board 62 substantially prevents flow of bypass gas thereby, and wherein a downstream collector board 64 defines at least a portion of a bypass gas outlet from the bypass gas collector 54. Further, a rotor shroud 74 (hoop shroud) may be provided, extending circumferentially about the rotor 104 to provide a bypass gas flow restrictive interior roof portion 78 above the bypass gas collectors 54. In an embodiment, an outer surface 79 of the rotor shroud 74 may be provided with a grooved portion 81 providing a labyrinth seal with respect to casing 160.

As seen in FIG. 7A, the compressor 18 may include an interconnecting a conduit 170 between the diverging outlet portion of the aerodynamic duct and the high pressure outlet volute 156 of the casing 160. With such a conduit 170, there may be located one or more outlet diffusers, such as diffusers 152 and 154. Such outlet diffusers 152 and 154 are adapted to slow high speed gas escaping the diverging outlet portion, to convert kinetic energy to static pressure in the high pressure outlet volute 156 of the casing 160.

In a method for starting a supersonic gas compressor, a compressor is provided including a rotor having one or more aerodynamic ducts mounted for rotary movement, wherein the aerodynamic ducts 20 have converging inlet portions and diverging outlet portions. The aerodynamic ducts include one or more structures that at supersonic inflow conditions generate oblique shock waves in a gas within the converging inlet portion and a normal shock wave in a gas as said gas enters or passes through the diverging outlet portion. The aerodynamic duct provided has an inlet relative Mach number for operation associated with a design operating point selected within a design operating envelope for a selected gas composition, gas quantity, and gas compression ratio. A method of starting includes initiating engagement of the converging inlet portion of the aerodynamic ducts with an inlet gas stream to be compressed. Then, a selected quantity of bypass gas is removed from the converging inlet portion as the aerodynamic duct increases in velocity while the gas therein transforms from a subsonic inflow condition to a supersonic condition at an inlet relative Mach number associated with a design operating point. The selected quantity of bypass gas removed increases as the inlet relative Mach number increases as selected for the desired design operating point. Generally, the quantity of bypass gas removed is selected from a range of (a) from about 11% by mass to about 19% by mass of the inlet gas captured by the converging inlet portion for operation at an inlet relative Mach number of about 1.8, to (b) from about 36% by mass to about 61% by mass of the inlet gas captured by the converging inlet portion for operation at an inlet relative Mach number of about 2.8. Exemplary operating conditions for such bypass gas removal amounts are suggested in FIG. 3. When the oblique shock waves are effectively stabilized within the design operating envelope of the supersonic gas compressor, the removal of a quantity of bypass gas from the converging inlet portion is effectively eliminated. In an embodiment, the removal of said bypass gas is completely terminated after the aerodynamic duct has reached a selected inlet relative Mach number for the design operating point. Thereafter, normal operation of the compressor occurs without removal of bypass gas.

In one aspect, the compressor startup method taught herein may be practiced in a compressor configuration wherein one of the converging inlet portions comprise exit conduits therein, and wherein removal of the bypass flow is conducted by removing gas through such exit conduits 40.

In short, the novel supersonic gas compressor described and claimed herein, and the method and apparatus for starting the same, can provide a significant benefit in compressor designs for high efficiency operation. The supersonic gas compressor described and claimed herein may be utilized to compress a variety of suitable gases. In an embodiment, such a compressor may be utilized to compress carbon dioxide. In another embodiment, the compressor may be utilized to compress propane.

In summary, whether for application for carbon dioxide sequestration, air separation, hydrocarbon processing, or other gas compression operation, and especially for gases having low sonic velocities and or high molecular weights, a novel supersonic gas compressor design has now been developed. Initial calculations have indicated that significant improvements in efficiency may be attained in such a design. And, an important consideration is that efficiency is increased since after starting using a significant bleed fraction, the bleed amount is reduced to little or nothing, i.e. essentially zero, as the compressor design, and especially the rotor design, is able to achieve stable operation in a desired very high compression ratio design range without ongoing removal of bypass bleed gas.

In the foregoing description, numerous details have been set forth in order to provide a thorough understanding of the disclosed exemplary embodiments for a novel supersonic gas compressor. However, certain of the described details may not be required in order to provide useful embodiments, or to practice a selected or other disclosed embodiments. Further, the description includes, for descriptive purposes, various relative terms such as adjacent, proximity, near, on, onto, on top, underneath, underlying, downward, lateral, base, floor, shroud, roof, ceiling, and the like. Such usage should not be construed as limiting. Terms that are relative only to a point of reference are not meant to be interpreted as absolute limitations, but are instead included in the foregoing description to facilitate understanding of the various aspects of the disclosed embodiments. Various steps or operations in method(s) described herein may have been described as multiple discrete operations, in turn, in a manner that is most helpful in understanding the method(s). However, the order of description should not be construed as to imply that such operations are necessarily order dependent. In particular, certain operations may not need to be performed in the order of presentation. And, in different embodiments, one or more operations may be performed simultaneously, or eliminated in part or in whole while other operations may be added. Also, the reader will note that the phrase "in one embodiment" has been used repeatedly. This phrase generally does not refer to the same embodiment; however, it may. Finally, the terms "comprising", "having" and "including" should be considered synonymous, unless the context dictates otherwise. Various aspects and embodiments described and claimed herein may be modified from those shown without materially departing from the novel teachings and advantages provided by this invention, and may be embodied in other specific forms without departing from the spirit or essential characteristics thereof. Embodiments presented herein are to be considered in all respects as illustrative and not restrictive or limiting. This disclosure is intended to cover methods and apparatus described herein, and not only structural equivalents thereof, but also equivalent structures. Modifications and variations are possible in light of the above teachings. Therefore, the protection afforded to this invention should be limited only by the claims set forth herein, and the legal equivalents thereof.

The invention claimed is:

1. A method for starting a supersonic gas compressor, said supersonic gas compressor comprising one or more aerodynamic ducts mounted for rotary movement, said one or more aerodynamic ducts comprising a converging inlet portion and a diverging outlet portion, said aerodynamic duct comprising one or more structures that at supersonic inflow conditions generate oblique shock waves in a gas within said converging inlet portion and a normal shock wave in a gas as said gas enters or passes through said diverging outlet portion, said aerodynamic duct having an inlet relative Mach number with a design operating point selected within a design operating envelope for a selected gas composition, gas quantity, and gas compression ratio, said method comprising initiating rotary movement of said converging inlet portion of said one or more aerodynamic duct(s)s with an inlet gas stream to be compressed;

removing a selected quantity of bypass gas from said converging inlet portion as said one or more aerodynamic duct(s) increase in rotary speed while said gas therein transforms from a subsonic inflow condition to a supersonic condition at an inlet relative Mach number associated with said design operating point, said selected quantity of bypass gas at an inlet relative Mach number associated with said design operating point being between (a) an upper limit described by the equation $$(m_{bld}/m_{cap})=0.0329M^4-0.3835M^3+1.5389M^2-2.150M+0.9632$$

and (b) a lower limit described by the equation $$(m_{bld}/m_{cap})=0.0197M^4-0.230M^3+0.9233M^2-1.29M+0.5779$$

wherein $m_{bld}$=mass of bypass gas removed from said aerodynamic duct(s), $m_{cap}$=mass of gas captured by said aerodynamic duct(s), M=the inlet relative Mach number for the aerodynamic duct(s), and effectively eliminating removal of said quantity of bypass gas from said converging inlet portion after said oblique shocks are effectively stabilized.

2. The method as set forth in claim 1, wherein removal of said bypass gas is completely terminated after said aerodynamic ducts(s) have reached a selected inlet relative Mach number for said design operating point, wherein normal operation of said compressor occurs without removal of bypass gas.

3. The method as set forth in claim 1, wherein the quantity of said bypass gas required at a selected aerodynamic duct inlet relative Mach number at a design operating point increases at increased inlet relative Mach number.

4. The method as set forth in claim 1, wherein said inlet relative Mach number of said aerodynamic duct is in excess of 1.8.

5. The method as set forth in claim 1, wherein said inlet relative Mach number of said aerodynamic duct is at least 2.

6. The method as set forth in claim 1, wherein said inlet relative Mach number of said aerodynamic duct is at least 2.5.

7. The method as set forth in claim 1, wherein said inlet relative Mach number is in excess of about 2.5.

8. The method as set forth in claim 1, wherein said inlet relative Mach number of said aerodynamic duct is between about 2 and about 2.5, inclusive of said bounding parameters.

9. The method as set forth in claim 1, wherein said inlet relative Mach number of said aerodynamic duct is between about 2.5 and about 2.8, inclusive of said bounding parameters.

10. The method as set forth in claim 1, wherein said inlet relative Mach number is between about 2 and about 2.5, inclusive of said bounding parameters.

11. The method as set forth in claim 4, wherein at the design operating point, the Mach number before said normal shock is in a range of from about 1.2 to about 1.5.

12. The method as set forth in claim 1, wherein said compressor comprises a plurality of aerodynamic ducts mounted on a rotor, and wherein said method comprises removal of bypass gas from said converging inlet portion of each of said aerodynamic ducts.

13. The method as set forth in claim 12, wherein removal of bypass gas further comprises discharging gas from said converging inlet portion through exit conduits located in said converging inlet portion.

14. The method as set forth in claim 12, wherein the number of aerodynamic ducts provided is selected from the group consisting of 3, 5, 7 and 9.

15. The method as set forth in claim 4, wherein said design operating envelope comprises a gas compression ratio of at least 3.

16. The method as set forth in claim 15, wherein said design operating envelope comprises a gas compression ratio of at least 5.

17. The method as set forth in claim 15, wherein said design operating envelope comprises a gas compression ratio of from about 3.75 to about 12, inclusive of said parameters.

18. The method as set forth in claim 15, wherein said design operating envelope comprises a gas compression ratio of from about 12 to about 30, inclusive of said parameters.

19. The method as set forth in claim 15, wherein said design operating envelope comprises a gas compression ratio of in excess of 30.

20. A method of starting a compressor for compressing a selected gas, said compressor comprising a casing, said casing further comprising a low pressure gas inlet for admitting a main flow of a selected gas to be compressed, and a high pressure gas exit for discharging a compressed flow of said selected compressed gas, a rotor journaled in said casing, said rotor comprising one or more aerodynamic ducts having a converging inlet portion and a diverging outlet portion, said aerodynamic ducts comprising one or more structures that at supersonic inflow conditions generate a plurality of oblique shock waves in a gas within said converging inlet portion and a normal shock wave in a gas as said gas enters or passes through said diverging outlet portion, said aerodynamic ducts having an inlet relative Mach number for operation associated with a design operating point selected within a design operating envelope for a selected gas composition, gas quantity, and gas compression ratio, a bypass passageway adapted to receive bypass gas from said aerodynamic ducts, said bypass gas passageway further comprising one or more bypass gas collectors, said one or more bypass gas collectors each co-located with one of said aerodynamic ducts and shaped and sized to facilitate removal of a bypass portion of gas directly from said aerodynamic ducts;

said method comprising:

raising the rotating speed of said rotor to compress said selected gas at supersonic inlet conditions;

removing a selected quantity of bypass gas from said converging inlet portion of said aerodynamic duct through said bypass gas collectors;

stabilizing said oblique shock wave at a selected inlet relative Mach number and compression ratio; and effectively ending removal of said bypass gas.

21. The method as set forth in claim 20, wherein said rotor comprises a plurality of leading edges, and wherein each one of said plurality of said leading edges corresponds to, and lies upstream from, one of said one or one or more aerodynamic ducts.

22. The method as set forth in claim 20, wherein each one of said converging inlet portions comprise exit conduits therein, and wherein removal of bypass gas comprises exit of said bypass gas through said exit conduits.

23. The method as set forth in claim 22, wherein bypass gas removed through said exit conduits comprises a quantity of (a) from about 11% by mass to about 19% by mass of the inlet gas captured by said converging inlet portion for operation at an inlet relative Mach number of about 1.8, to (b) from about 36% by mass to about 61% by mass of the inlet gas captured by said converging inlet portion for operation at an inlet relative Mach number of about 2.8.

24. The method as set forth in claim 20 or in claim 22, wherein the quantity of said bypass gas removed is between an upper limit described by the equation $$(m_{bld}/m_{cap})=0.0329M^4-0.3835M^3+1.5389M^2-2.150M+0.9632$$

and a lower limit described by the equation $$(m_{bld}/m_{cap})=0.0197M^4-0.230M^3+0.9233M^2-1.29M+0.5779$$

wherein $m_{bld}$=mass of bypass gas removed from said aerodynamic ducts, $m_{cap}$=mass of gas captured by said aerodynamic ducts, M=the inlet relative Mach number for the aerodynamic ducts.

25. The method as set forth in claim 24, wherein removal of bypass gas comprises discharging gas from said converging inlet portion through exit conduits in a bounding portion of said converging inlet portion.

26. The method as set forth in claim 20, wherein the number of aerodynamic ducts provided is selected from the group consisting of 3, 5, 7 and 9.

27. The method as set forth in any one of claim 25, wherein at the design operating point, the Mach number before said normal shock is in a range of from about 1.2 to about 1.5.

28. The method as set forth in claim 27, wherein said design operating envelope comprises a gas compression ratio of at least 3.

29. The method as set forth in claim 27, wherein said design operating envelope comprises a gas compression ratio of at least 5.

30. The method as set forth in claim 27, wherein said design operating envelope comprises a gas compression ratio of from about 3.75 to about 12, inclusive of said parameters.

31. The method as set forth in claim 27, wherein said design operating envelope comprises a gas compression ratio of from about 12 to about 30, inclusive of said parameters.

32. The method as set forth in claim 27, wherein said design operating envelope comprises a gas compression ratio of in excess of 30.

33. The method as set forth in claim 20, wherein said selected gas comprises a hydrocarbon gas.

34. The method as set forth in claim 33, wherein said selected gas comprises one or more gases selected from the group consisting of ethane, propane, butane, pentane, and hexane.

35. The compressor as set forth in claim 20, wherein said selected gas comprises carbon dioxide.

36. A supersonic gas compressor, comprising:

a casing, said casing further comprising a low pressure gas inlet for admitting a main flow of a selected gas to be compressed, and a high pressure gas exit for discharging a compressed flow of said selected compressed gas, a rotor journaled in said casing, said rotor comprising one or more aerodynamic ducts having a converging inlet portion and a diverging outlet portion, said aerodynamic ducts comprising one or more structures that at supersonic inflow conditions generate a plurality of oblique shock waves in a gas within said converging inlet portion and a normal shock wave in a gas as said gas enters or passes through said diverging outlet portion, said aerodynamic ducts having an inlet relative Mach number for operation associated with a design operating point selected within a design operating envelope for a selected gas composition, gas quantity, and gas compression ratio, a bypass gas passageway, said bypass gas passageway having an open position, for use during bypass gas passage during starting of said gas compressor, and a closed position where gas bypass passage is effectively eliminated, for use after stabilizing said oblique shocks;

said bypass gas passageway adapted to receive bypass gas from said aerodynamic ducts, said bypass gas passageway further comprising one or more bypass gas collectors, and a plurality of exit conduits, said one or more bypass gas collectors each co-located with one of said aerodynamic ducts and mounted for rotary movement therewith, said bypass gas collectors shaped and sized to facilitate removal of a bypass portion of gas from said aerodynamic ducts via exit conduits defined by sidewalls between an aerodynamic duct bounding portion of said converging inlet portion and said bypass gas collectors.

37. The compressor as set forth in claim 36, wherein said bypass gas passageway is sized for increased capacity for removal of a selected quantity of bypass gas as said inlet relative Mach number increases, wherein the selected quantity of said bypass gas removed is between an upper limit described by the equation $$(m_{bld}/m_{cap})=0.0329M^4-0.3835M^3+1.5389M^2-2.150M+0.9632$$

and a lower limit described by the equation $$(m_{bld}/m_{cap})=0.0197M^4-0.230M^3+0.9233M^2-1.29M+0.5779$$

wherein $m_{bld}$=mass of bypass gas removed from said aerodynamic duct(s), $m_{cap}$=mass of gas captured by said aerodynamic duct(s), M=the inlet relative Mach number for the aerodynamic duct(s).

38. The compressor as set forth in claim 36, wherein said inlet relative Mach number of said aerodynamic duct is in excess of 1.8.

39. The compressor as set forth in claim 36, wherein said inlet relative Mach number of said aerodynamic duct is at least 2.

40. The compressor as set forth in claim 36, wherein said inlet relative Mach number of said aerodynamic duct is at least 2.5.

41. The compressor as set forth in claim 36, wherein said inlet relative Mach number is in excess of about 2.5.

42. The compressor as set forth in claim 36, wherein said inlet relative Mach number of said aerodynamic duct is between about 2 and about 2.5, inclusive of said bounding parameters.

43. The compressor as set forth in claim 36, wherein said inlet relative Mach number of said aerodynamic duct is between about 2.5 and about 2.8, inclusive of said bounding parameters.

44. The compressor as set forth in claim 36, wherein said inlet relative Mach number is between about 2 and about 2.5, inclusive of said bounding parameters.

45. The compressor as set forth in claim 38, wherein at the design operating point, the Mach number before said normal shock is in a range of from about 1.2 to about 1.5.

46. The compressor as set forth in claim 36, wherein said compressor comprises a plurality of aerodynamic ducts mounted on said rotor, and wherein bypass gas collectors are co-located with each of said aerodynamic ducts.

47. The compressor as set forth in claim 46, wherein three aerodynamic ducts are provided.

48. The compressor as set forth in claim 36 or in claim 38, wherein said design operating envelope comprises a gas compression ratio of at least 3.

49. The compressor as set forth in claim 48, wherein said design operating envelope comprises a gas compression ratio of at least 5.

50. The compressor as set forth in claim 48, wherein said design operating envelope comprises a gas compression ratio of from about 3.75 to about 12, inclusive of said parameters.

51. The compressor as set forth in claim 48, wherein said design operating envelope comprises a gas compression ratio of from about 12 to about 30, inclusive of said parameters.

52. The compressor as set forth in claim 48, wherein said design operating envelope comprises a gas compression ratio in excess of 30.

53. The compressor as set forth in claim 36, wherein said aerodynamic ducts comprise a converging inlet having a compression ramp that compresses incoming gas at least partially radially outward.

54. The compressor as set forth in claim 53, wherein said bypass gas collectors are provided at a location outward from said compression ramp.

55. The compressor as set forth in claim 54, wherein said bypass gas collectors are provided at a location inward from said compression ramp.

56. The compressor as set forth in claim 53, further comprising a second compression ramp, said second compression ramp oriented to compress incoming gas at least partially radially inward.

57. The compressor as set forth in claim 56, wherein said bypass gas collectors are provided at a location (a) outward from said compression ramp, and (b) inward from said compression ramp.

58. The compressor as set forth in claim 36, wherein said aerodynamic ducts comprise a converging inlet having a compression ramp that compresses incoming gas at least partially radially inward.

59. The compressor as set forth in claim 36, wherein said bypass gas collectors comprise chambers at least partially defined by a floor comprising an exterior portion of a bounding portion of said aerodynamic duct.

60. The compressor as set forth in claim 59, wherein said bypass gas collectors comprise chambers at least partially defined by axially oriented and radially extending opposing ribs.

61. The compressor as set forth in claim 59, wherein said bypass gas collectors comprise chambers at least partially defined by opposing collector boards, said opposing collector boards provided in pairs, wherein an upstream collector board substantially prevents flow of bypass gas thereby, and wherein a downstream collector board defines at least a portion of a bypass gas outlet from said bypass gas collector.

62. The compressor as set forth in claim 36 or in claim 59, further comprising a hoop shroud, said hoop shroud extending circumferentially about said rotor to provide a bypass gas flow restrictive roof above said bypass gas collector.

63. The compressor as set forth in claim 62, wherein said hoop shroud comprises an annular hoop.

64. The compressor as set forth in claim 63, wherein said aerodynamic ducts are bounded between strakes.

65. The compressor as set forth in claim 64, wherein said strakes are helical.

66. The compressor as set forth in claim 65, wherein said helical strakes laterally bound said aerodynamic ducts.

67. The compressor as set forth in claim 62, wherein said hoop shroud comprises an outer surface, said outer surface further providing a grooved portion providing a labyrinth seal with respect to said casing.

68. The compressor as set forth in claim 36, further comprising a valve associated with said bypass gas passageways, said valve configured to open and close said bypass gas passageways.

69. The compressor as set forth in claim 36, wherein said bypass gas passageway returns said bypass gas to said low pressure gas inlet.

70. The compressor as set forth in claim 36, further comprising an interconnecting a conduit between said diverging outlet portion of said aerodynamic duct and said high pressure outlet of said casing.

71. The compressor as set forth in claim 70, further comprising outlet diffusers, said outlet diffusers adapted to slow high speed gas escaping said diverging outlet portion to convert kinetic energy to pressure in said high pressure outlet of said casing.

* * * * *

UNITED STATES PATENT AND TRADEMARK OFFICE

CERTIFICATE OF CORRECTION

PATENT NO. : 8,152,439 B2
APPLICATION NO. : 12/355702
DATED : April 10, 2012
INVENTOR(S) : Shawn P. Lawlor It is certified that error appears in the above-identified patent and that said Letters Patent is hereby corrected as shown below:

IN THE SPECIFICATION:

Column 5, line 24, after the words "portion 22 having", delete "a".

Column 5, line 25, after the words "ramps 24", insert --that--.

Column 5, line 51, after the words "shock waves", delete "S1, S2, S3, S4," and substitute therefore --$S_1$, $S_2$, $S_3$, $S_4$,--.

Column 11, line 66, after the words "of at least 3.", delete "On" and substitute therefore --In--.

Signed and Sealed this
Fourth Day of December, 2012

David J. Kappos

David J. Kappos
*Director of the United States Patent and Trademark Office*